US007920110B2

(12) United States Patent
Chiou

(10) Patent No.: US 7,920,110 B2
(45) Date of Patent: Apr. 5, 2011

(54) PIXEL CIRCUIT

(75) Inventor: Yu-Wen Chiou, Sinshih Township (TW)

(73) Assignee: Himax Technologies Limited, Tainan (TW)

( * ) Notice: Subject to any disclaimer, the term of this patent is extended or adjusted under 35 U.S.C. 154(b) by 926 days.

(21) Appl. No.: 11/692,258

(22) Filed: Mar. 28, 2007

(65) Prior Publication Data

US 2008/0238890 A1 Oct. 2, 2008

(51) Int. Cl.
*G09G 3/32* (2006.01)

(52) U.S. Cl. ..... 345/82; 345/55; 345/204

(58) Field of Classification Search ..... 345/55, 345/82, 76, 204
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 2004/0150595 | A1 * | 8/2004 | Kasai | 345/82 |
| 2004/0196224 | A1 * | 10/2004 | Kwon | 345/82 |
| 2004/0257315 | A1 * | 12/2004 | Wang et al. | 345/82 |
| 2005/0219166 | A1 * | 10/2005 | Kim | 345/76 |
| 2006/0158397 | A1 * | 7/2006 | Goh | 345/76 |

* cited by examiner

*Primary Examiner* — Amare Mengistu
*Assistant Examiner* — Koosha Sharifi

(57) ABSTRACT

A pixel circuit has an organic light emitting diode, a driving transistor, a capacitor and a first switch. The organic light emitting diode has a first end coupled to a first power source terminal. The driving transistor has a source and a drain respectively coupled to a second power source terminal and a second end of the light emitting diode. The capacitor couples a gate of the driving transistor to a reference voltage terminal. The first switch couples the second end of the light emitting diode to the capacitor, and couples the gate and the drain of the driving transistor together when a first scan signal is asserted.

6 Claims, 10 Drawing Sheets

PIXEL CIRCUIT

BACKGROUND

1. Field of Invention

The present invention relates to a pixel circuit, and more particularly relates to an AMOLED voltage type compensation pixel circuit.

2. Description of Related Art

FIG. 1 shows an organic light emitting diode pixel circuit of the prior art. The pixel circuit is a voltage type compensation pixel circuit. The pixel circuit has an organic light emitting diode 180, a first transistor 170, a driving transistor 130, a capacitor 150, and a second transistor 110. The first transistor 170 has a source/drain 176 coupled to the light emitting diode 180, wherein the first transistor 170 is controlled by a first scan signal (SCAN1). The driving transistor 130 has source/drains 132 and 136. The source/drain 132 couples to a power source terminal 140 through the transistor 160, and the source/drain 136 couples to a source/drain 172 of the first transistor 170. The capacitor 150 couples a gate 134 of the driving transistor 130 to the power source terminal 140. When a second scan signal (SCAN2) is asserted, the second transistor 110 respectively couples the source/drain 172 of the first transistor 170 to the capacitor 150, and couples the gate 134 and the source/drain 136 of the driving transistor 130 together.

The pixel circuit also has a third transistor 190 controlled by the second scan signal to couple a data line 120 and the source/drain 132 of the driving transistor 130.

The drawback of the conventional pixel circuit is that it has five transistors (transistors 110, 130, 160, 170 and 190). These transistors reduce the aperture ratio of the pixel circuit.

SUMMARY

According to one embodiment of the present invention, the pixel circuit has an organic light emitting diode, a driving transistor, a capacitor and a first switch. The organic light emitting diode has a first end coupled to a first power source terminal. The driving transistor has a source and a drain respectively coupled to a second power source terminal and a second end of the light emitting diode. The capacitor couples a gate of the driving transistor to a reference voltage terminal. The first switch couples the second end of the light emitting diode to the capacitor, and couples the gate and the drain of the driving transistor together when a first scan signal is asserted.

According to another embodiment of the present invention, the pixel circuit operates during a precharge stage, a programming stage, and a display stage sequentially. The pixel circuit has an organic light emitting diode, a driving transistor, a capacitor, and a first switch. The organic light emitting diode has a first end coupled to a first power source terminal. The driving transistor has a source and a drain respectively coupled to a second power source terminal and a second end of the light emitting diode. The capacitor couples a gate of the driving transistor to a reference voltage terminal. The first switch is controlled by a first scan signal to coupe/decouple the second end of the organic light emitting diode to/from the gate of the driving transistor. The first scan signal is asserted during the precharge and programming stages, and the first scan signal is deasserted during the display stage.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
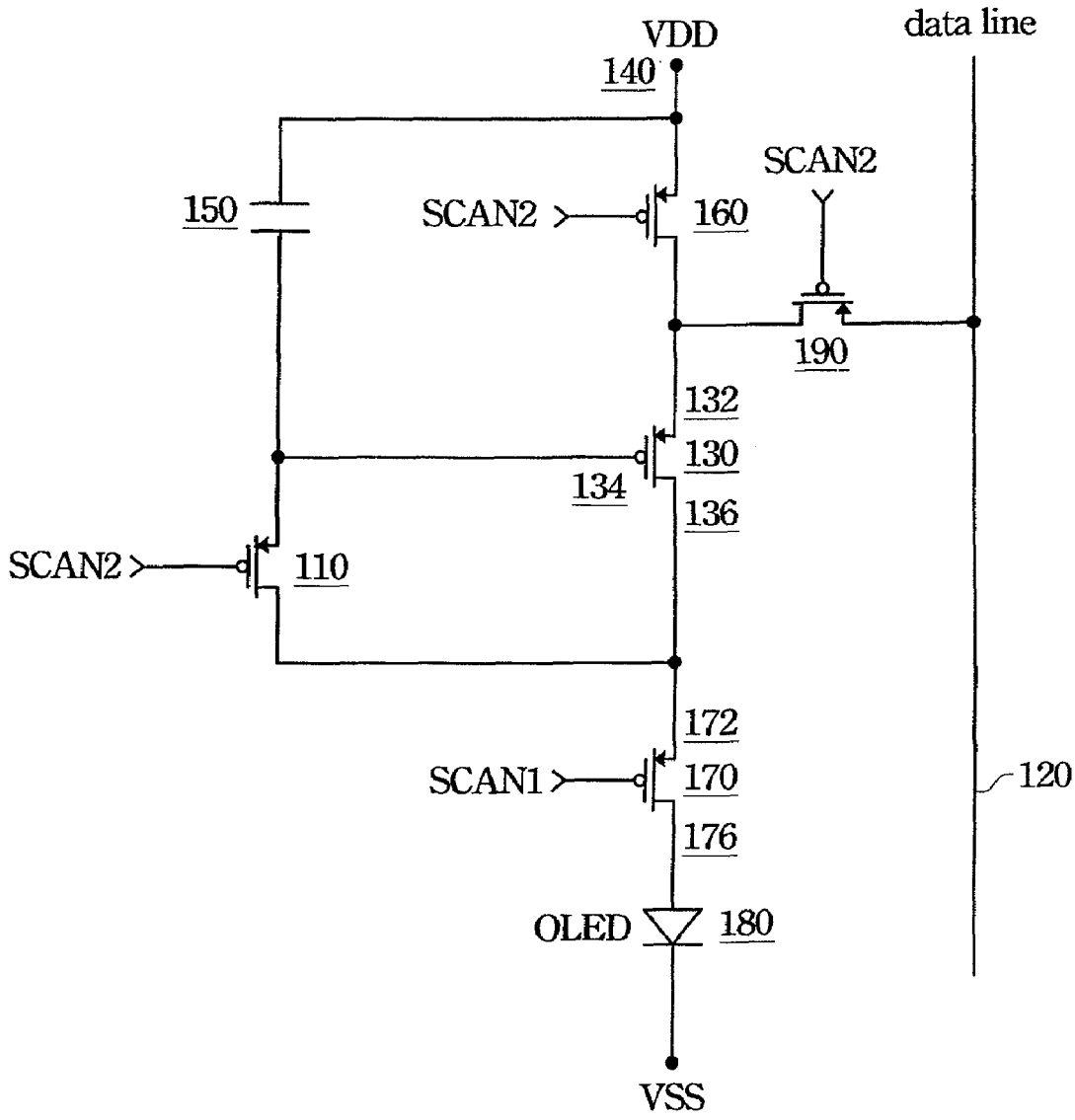
Fig. 1 (prior art)
FIG. 1 shows an organic light emitting diode pixel circuit of the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
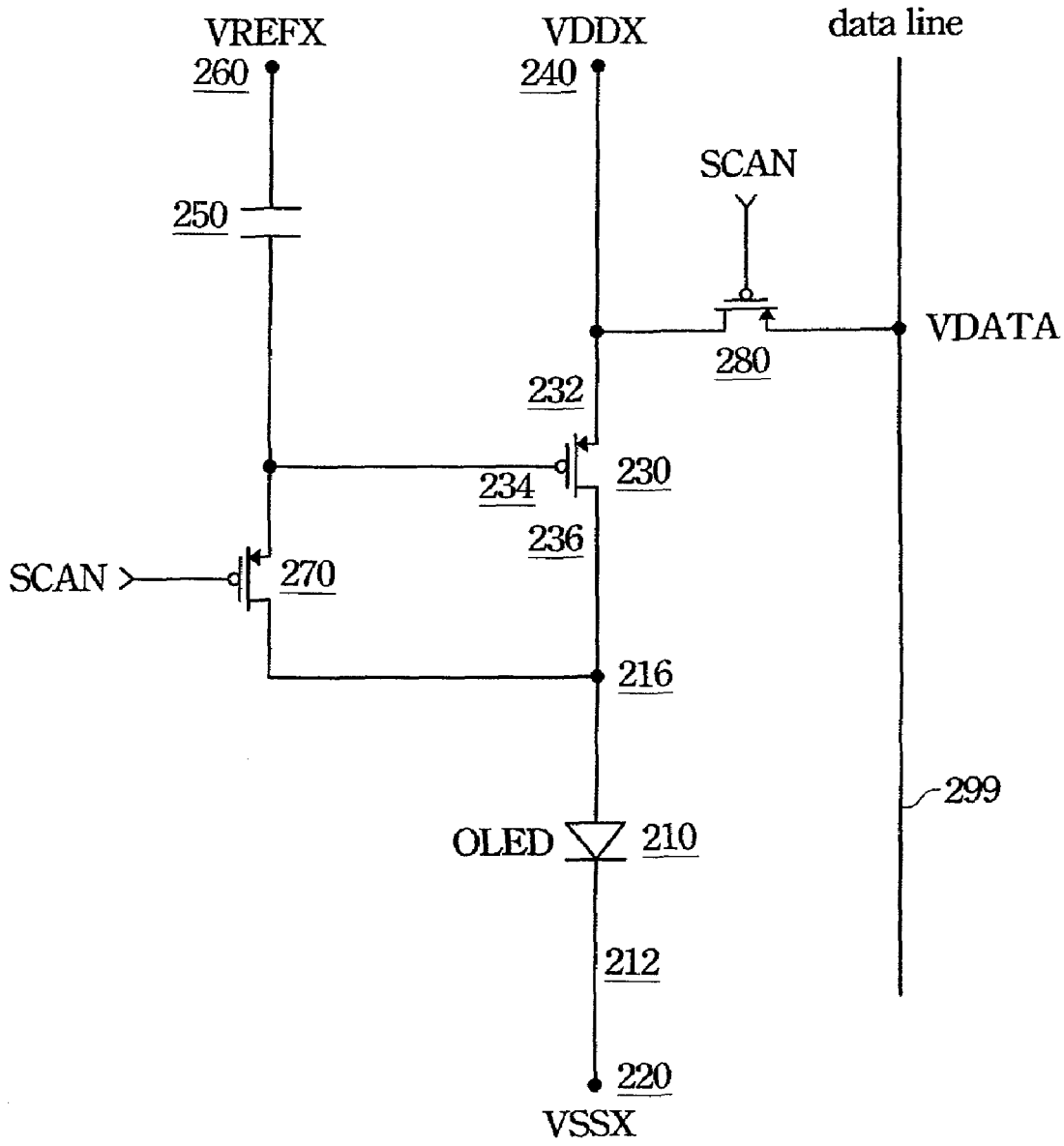
FIG. 2A shows an organic light emitting diode pixel circuit according to an embodiment of the invention.

FIG. 2A shows an organic light emitting diode pixel circuit according to an embodiment of the invention. The pixel circuit is a voltage type compensation pixel circuit with PMOS transistors. The pixel circuit has an organic light emitting diode 210, a driving transistor 230, a capacitor 250 and a first switch 270. The organic light emitting diode 210 has a first end 212 coupled to a first power source terminal 220. The driving transistor 230 has a source 232 and a drain 236 respectively coupled to a second power source terminal 240 and a second end 216 of the light emitting diode 210. The capacitor 250 couples a gate 234 of the driving transistor 230 to a reference voltage terminal 260. The first switch 270 couples the second end 216 of the light emitting diode 210 to the capacitor 250, and couples the gate 234 and the drain 236 of the driving transistor 230 together when a first scan signal (SCAN) is asserted.

The pixel circuit has a second switch 280 controlled by the first scan signal (SCAN) to couple the source 232 of the driving transistor 230 to a data line 299. Therefore, when the first scan signal is asserted, the data signals from the data line 299 are transmitted to the pixel circuit.

Figure 2B:
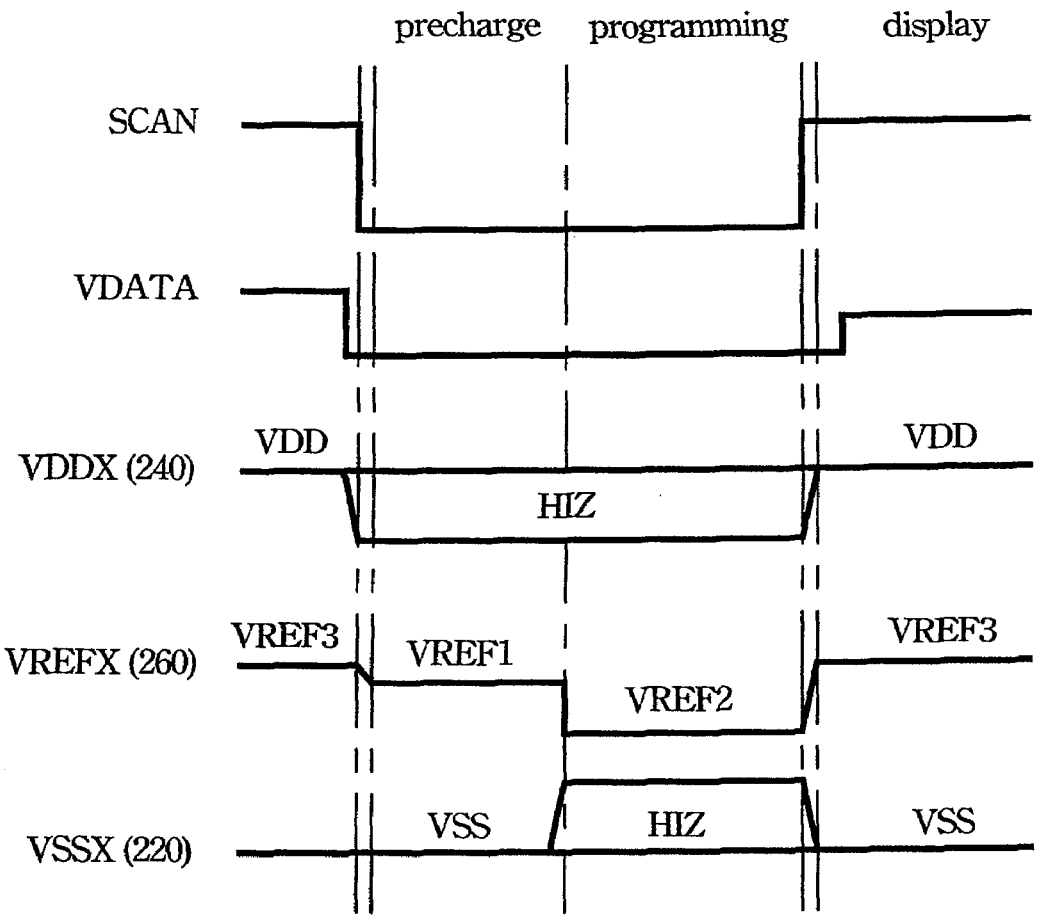
FIG. 2B shows the waveform diagrams of the signals of the embodiment shown in FIG. 2A.

FIG. 2B shows the waveform diagrams of the signals of the embodiment shown in FIG. 2A. The pixel circuit is a voltage compensation type pixel circuit. The first scan signal (SCAN) turns on the first switch 270 and the second switch 280 during a precharge and a programming stages, and turns off the first switch 270 and the second switch 280 during the display stage.

The second power source terminal 240 (VDDX) floats (HIZ, high impedance) during the precharge and programming stages (i.e. when the first scan signal, SCAN, is asserted) and has a high voltage (VDD) to supply power to the organic light emitting diode 210 during the display stage.

The reference voltage terminal 260 provides a first reference voltage (VREF1) when the pixel circuit is in the precharge stage, provides a second reference voltage (VREF2) when the pixel circuit is in the programming stage, and provides a third reference voltage (VREF3) when the pixel circuit is in the display stage. The driving transistor 230 is a PMOS transistor, thus the second reference voltage is not higher than (lower than or equal to) the first reference voltage. Therefore, the lower voltage, second reference voltage, makes writing the data signals (VDATA) into the pixel circuit easy in the programming stage. Moreover, the low second reference voltage also enables the pixel circuit to be driven by low voltage data signals. Thus, the pixel circuit can operate with low power consumption.

Otherwise, the first power source terminal 220 provides a ground voltage when the pixel circuit is in the precharge stage, makes the first end 212 of the organic light emitting diode 210 high impedance (HIZ) when the pixel circuit is in the programming stage, and provides the ground voltage when the pixel circuit is in the display stage. Therefore, the high impedance at the first end 212 of the organic light emitting diode 210 also improves the pixel circuit's performance of the programming stage.

The first switch 270, the second switch 210 and the third switch 290 can be implemented by transistors. In this embodiment shown in the FIG. 2A, the switches 270, 210 and 290 are PMOS transistors. If the switches 270, 210 and 290 are configured by NMOS transistors, the control signals have to be inversed.

Compared with the prior art in FIG. 1, there are only three transistors (switches 270, 280, and the driving transistor 230) in this embodiment. Therefore, the aperture ratio of each pixel circuit is increased thereby.

Figure 2C:
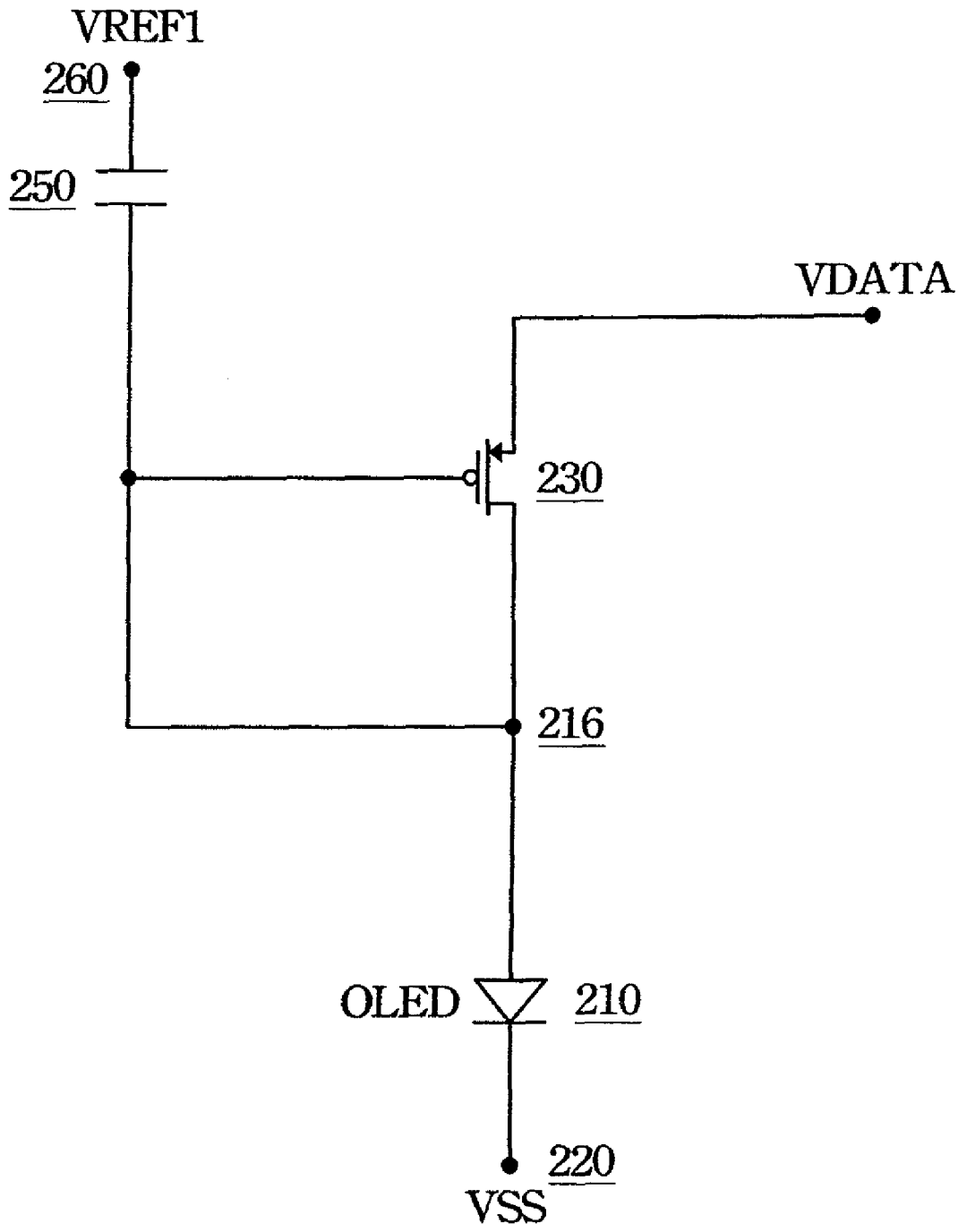
FIG. 2C shows the organic light emitting diode pixel circuit during a precharge stage according to the embodiment of the invention.
Figure 2D:
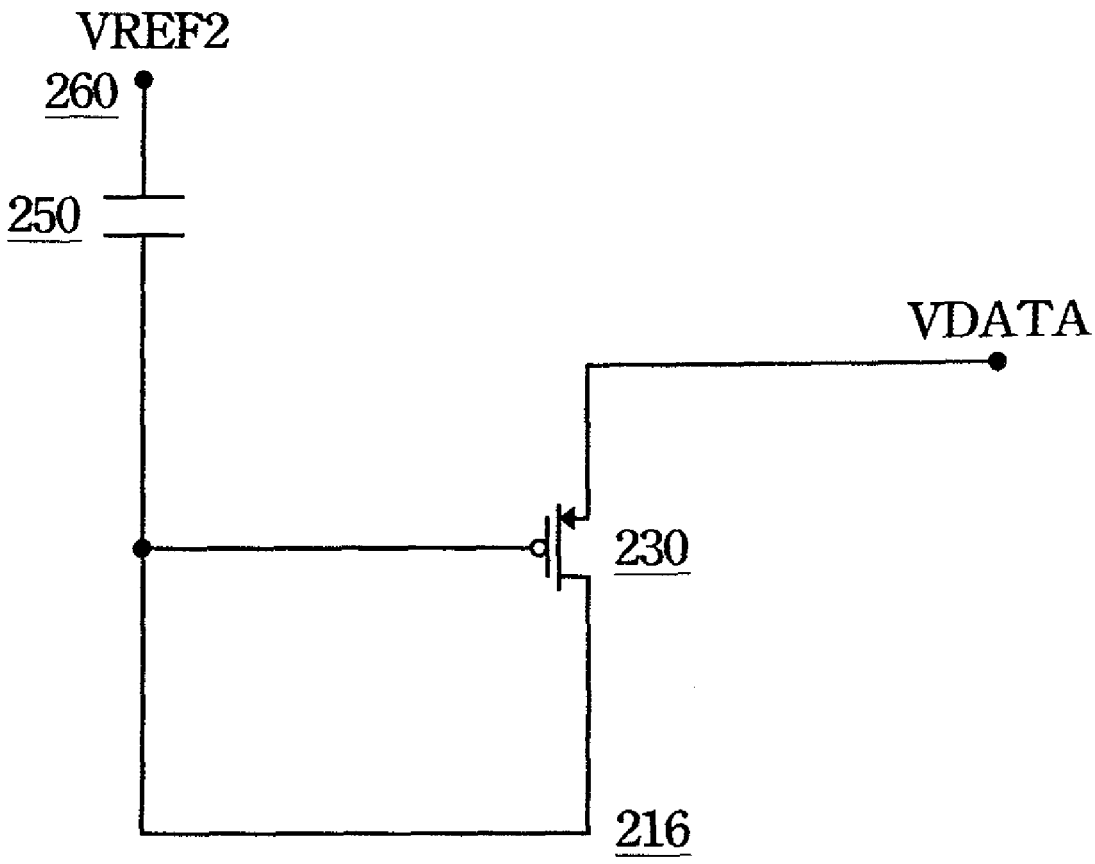
FIG. 2D shows the organic light emitting diode pixel circuit during a programming stage according to the embodiment of the invention.
Figure 2E:
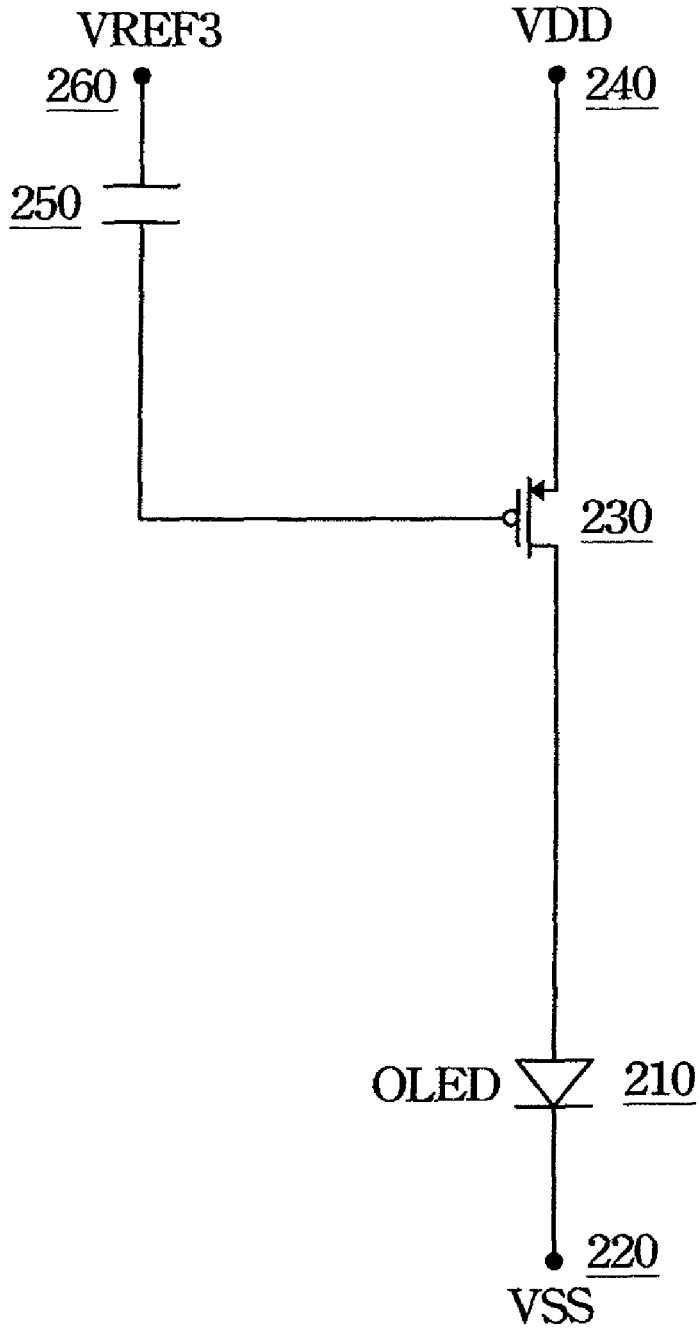
FIG. 2E shows the organic light emitting diode pixel circuit during a display stage according to the embodiment of the invention.

FIG. 2C. FIG. 2D and FIG. 2E respectively show the organic light emitting diode pixel circuit during the precharge, programming and display stages according to the embodiment of the invention. The pixel circuit operates during the precharge stage, the programming stage, and the display stage sequentially. Refer to the FIG. 2A at the same time, the pixel circuit has an organic light emitting diode 210, a driving transistor 230, a capacitor 250, and a first switch 270. The organic light emitting diode 210 has a first end 212 coupled to a first power source terminal 220. The driving transistor 230 has a source 232 and a drain 236 respectively coupled to a second power source terminal 240 and a second end 216 of the light emitting diode 210. The capacitor 250 couples a gate 234 of the driving transistor 230 to a reference voltage terminal 260. The first switch 270 controlled by a first scan signal to coupe/decouple the second end 216 of the organic light emitting diode 210 to/from the gate 234 of the driving transistor 230.

The first scan signal is asserted during the precharge (FIG. 2C) and programming (FIG. 2D) stages, and the first scan signal is de-asserted during the display stage (FIG. 2E). Therefore, the capacitor 250 is coupled to the light emitting diode 210 during the precharge and programming stages in the FIG. 2C and FIG. 2D, and is decoupled from the light emitting diode 210 during the display stage in the FIG. 2E.

Figure 3A:
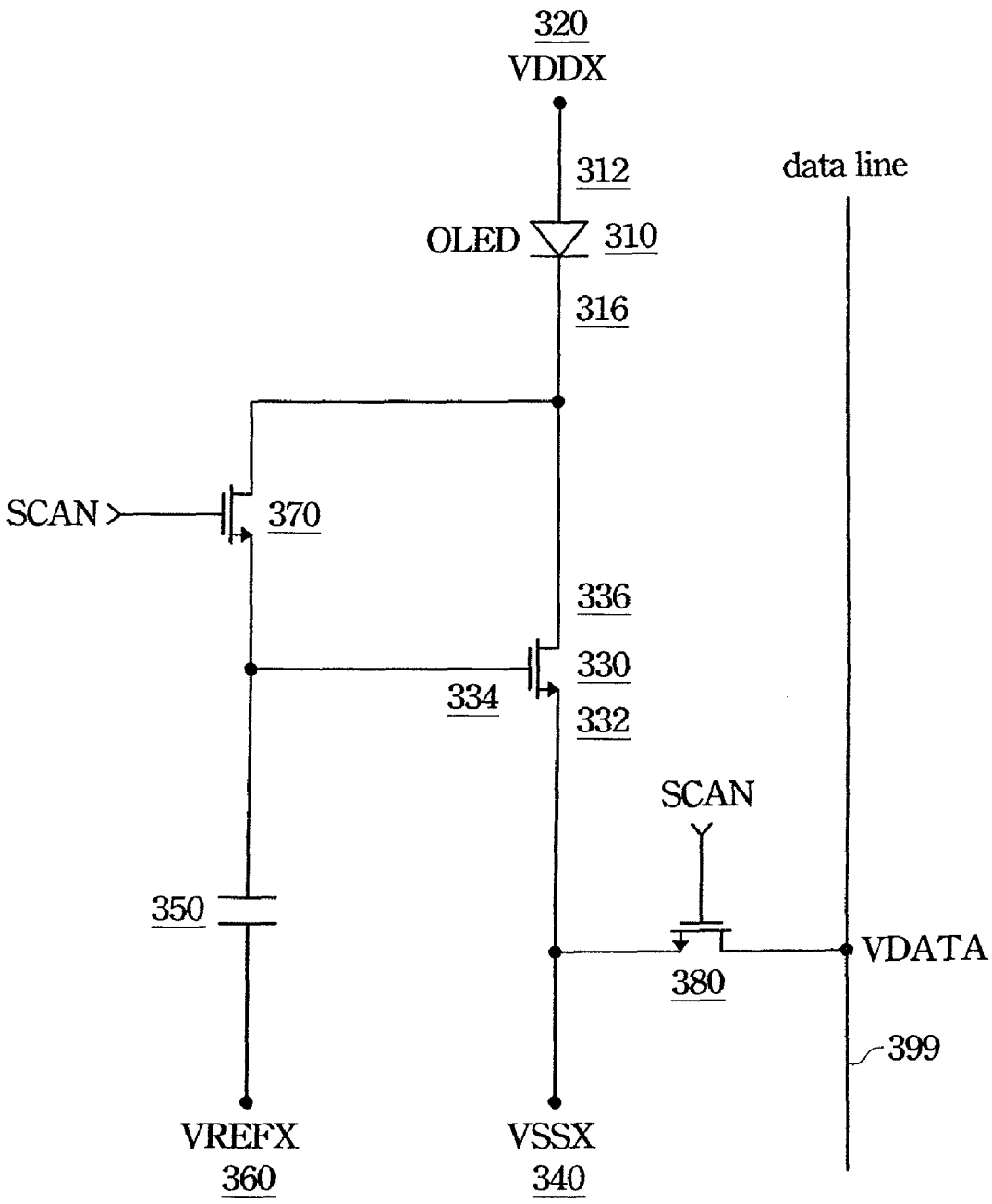
FIG. 3A shows an organic light emitting diode pixel circuit according to another embodiment of the invention.

FIG. 3A shows an organic light emitting diode pixel circuit according to another embodiment of the invention. The pixel circuit is a voltage type compensation pixel circuit with NMOS transistors. The pixel circuit has an organic light emitting diode 310, a driving transistor 330, a capacitor 350 and a first switch 370. The organic light emitting diode 310 has a first end 312 coupled to a first power source terminal 320. The driving transistor 330 has a source 332 and a drain 336 respectively coupled to a second power source terminal 340 and a second end 316 of the light emitting diode 310. The capacitor 350 couples a gate 334 of the driving transistor 330 to a reference voltage terminal 360. The first switch 370 couples the second end 316 of the light emitting diode 310 to the capacitor 350, and couples the gate 334 and the drain 336 of the driving transistor 330 together when a first scan signal (SCAN) is asserted.

The pixel circuit has a second switch 380 controlled by the first scan signal (SCAN) to couple the source 332 of the driving transistor 330 to a data line 399. Therefore, when the first scan signal is asserted, the data signals from the data line 399 are transmitted to the pixel circuit.

Figure 3B:
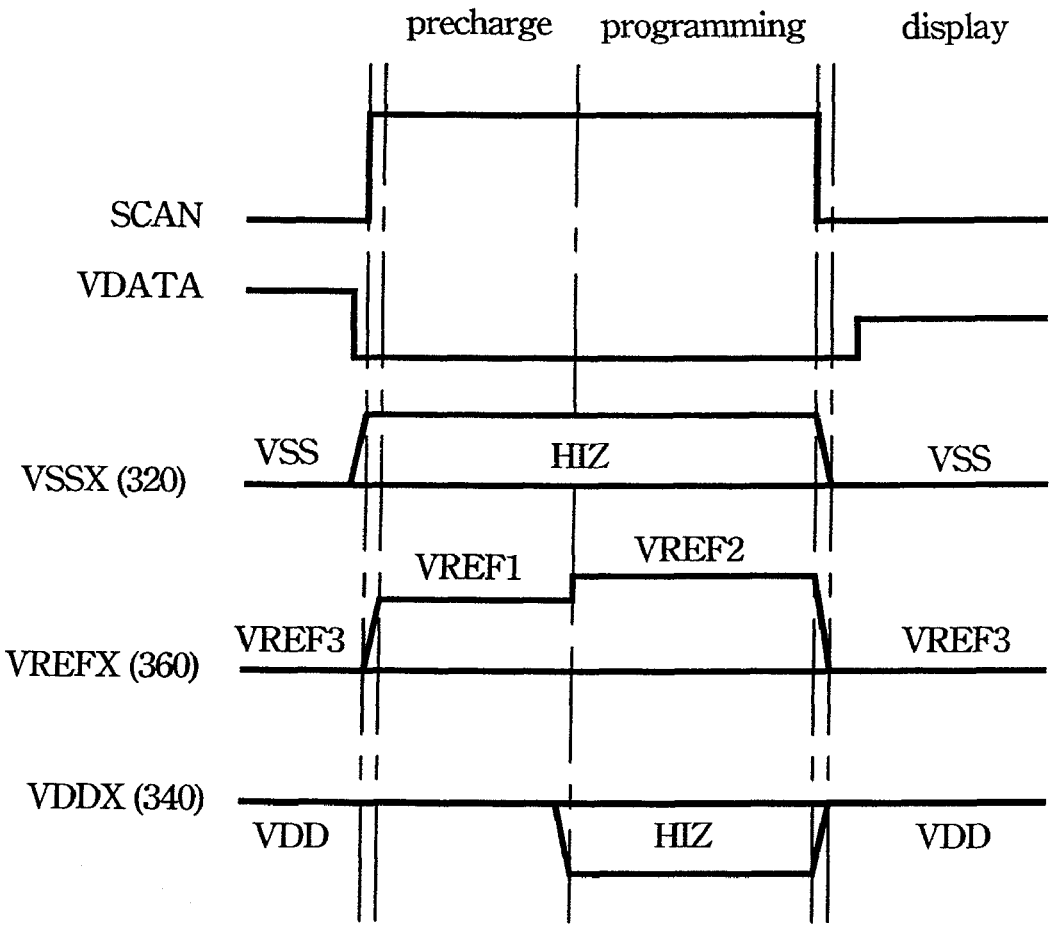
FIG. 3B shows the waveform diagrams of the signals of the embodiment shown in FIG. 3A.

FIG. 3B shows the waveform diagrams of the signals of the embodiment shown in FIG. 3A. Since the pixel circuit of FIG. 2A is implemented by PMOS transistors, and the pixel circuit of FIG. 3A is implemented by NMOS transistors, the waveform diagrams of FIG. 2B and FIG. 3B are opposite. The driving transistor 330 is a NMOS transistor, thus the second reference voltage (VREF2) is not lower than (higher than or equal to) the first reference voltage (VREF1). Therefore, the lower voltage, second reference voltage, makes writing the data signals (VDATA) into the pixel circuit easy in the programming stage. Moreover, the low second reference voltage also enable the pixel circuit to be driven by the data signals with low voltages. Thus, the pixel circuit can operate with low power consumption.

Figure 4A:
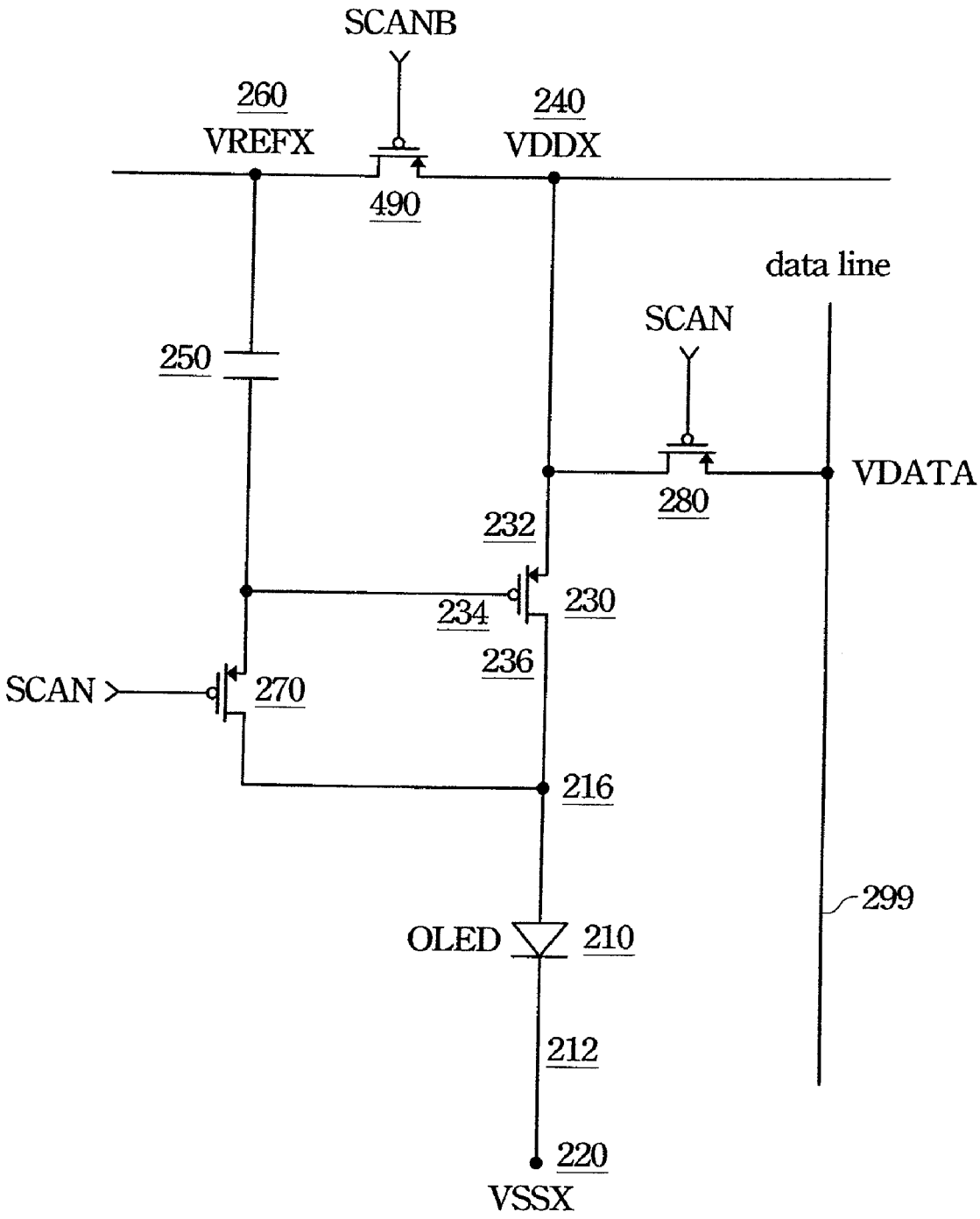
FIG. 4A shows an organic light emitting diode pixel circuit according to another embodiment of the invention.

FIG. 4A shows an organic light emitting diode pixel circuit according to another embodiment of the invention. This pixel circuit is implemented by PMOS transistors, and it also can be implemented by NMOS transistors. The difference between the embodiments of FIG. 2A and FIG. 4A is that the pixel circuit in FIG. 4A has a third switch 490 controlled by a second scan signal (SCANB) to couple the second power source terminal 240 to the reference voltage terminal 260.

Figure 4B:
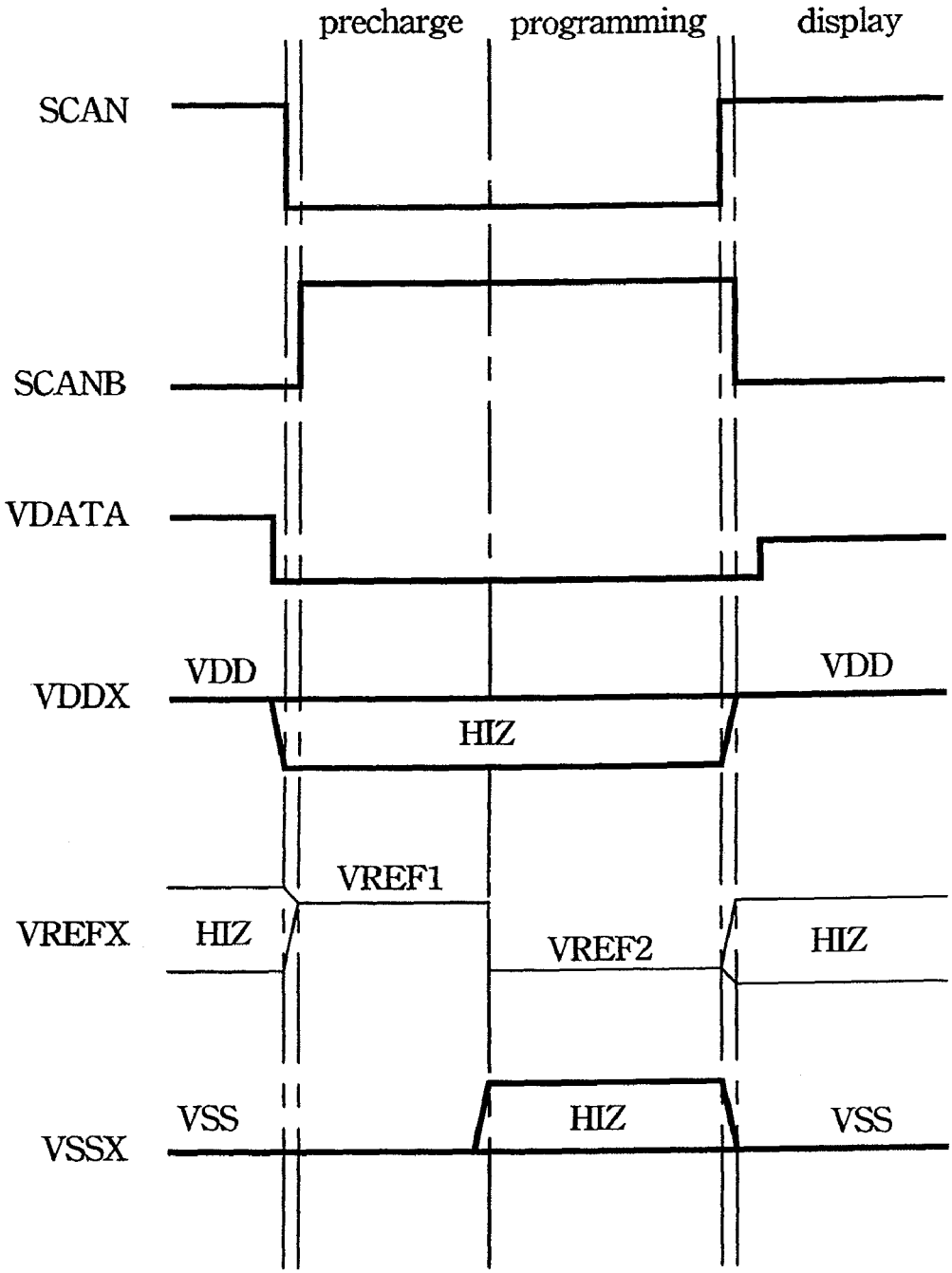
FIG. 4B shows the waveform diagrams of the signals of the embodiment shown in FIG. 4A.

FIG. 4B shows the waveform diagrams of the signals of the embodiment shown in FIG. 4A. The first scan signal (SCAN) and the second scan signal (SCANB) are opposite. Therefore, the second power source terminal 240 and the reference voltage terminal 260 are disconnected when the second scan signal is deasserted at the precharge and programming stages. The third switch 490 is turned on to couple the reference voltage terminal 260 to the second power source terminal 240 when the pixel circuit operates in the display stage. Thus the voltages at the reference voltage terminal 260 and the second power source terminal 240 in the display stage are VDD.

By the description above, the embodiments of this invention with the voltage compensation function has fewer transistors than the conventional pixel circuit. Otherwise, the variable voltages at the reference voltage terminal make the pixel circuit operates more efficiently than the conventional pixel circuit, too.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel circuit, comprising:

a light emitting diode with a first end coupled to a first power source terminal;

a driving transistor with a source and a drain respectively coupled to a second power source terminal and a second end of the light emitting diode;

a capacitor coupling a gate of the driving transistor to a reference voltage terminal; and a first switch, when a first scan signal is asserted, coupling the second end of the light emitting diode to the capacitor, and coupling the gate and the drain of the driving transistor together;

wherein the reference voltage terminal provides a first reference voltage when the pixel circuit is in a precharge stage;

wherein the reference voltage terminal provides a second reference voltage when the pixel circuit is in a programming stage; and wherein the second reference voltage is not higher than the first reference voltage when the driving transistor is a PMOS transistor.

2. The pixel circuit as claimed in claim 1, further comprising a second switch controlled by the first scan signal to couple the source of the driving transistor to a data line.

3. The pixel circuit as claimed in claim 1, wherein the second power source terminal makes the source of the driving transistor high impedance when the pixel circuit operates in a precharge stage and a programming stage.

4. The pixel circuit as claimed in claim 1, wherein the first power source terminal makes the first end of the light emitting diode high impedance when the pixel circuit operates in a programming stage.

5. The pixel circuit as claimed in claim 1, wherein the first power source terminal provides the ground voltage when the pixel circuit operates in a display stage.

6. A pixel circuit, comprising:

a light emitting diode with a first end coupled to a first power source terminal;

a driving transistor with a source and a drain respectively coupled to a second power source terminal and a second end of the light emitting diode;

a capacitor coupling a gate of the driving transistor to a reference voltage terminal;

a first switch, when a first scan signal is asserted, coupling the second end of the light emitting diode to the capacitor, and coupling the gate and the drain of the driving transistor together; and a second switch controlled by the first scan signal to couple the source of the driving transistor to a data line;

wherein the reference voltage terminal provides a first reference voltage when the pixel circuit is in a precharge stage;

wherein the reference voltage terminal provides a second reference voltage when the pixel circuit is in a programming stage;

wherein the second reference voltage is not higher than the first reference voltage when the driving transistor is a PMOS transistor;

wherein the second power source terminal makes the source of the driving transistor high impedance when the pixel circuit operates in a precharge stage and a programming stage;

wherein the first power source terminal makes the first end of the light emitting diode high impedance when the pixel circuit operates in a programming stage; and wherein the first power source terminal provides the ground voltage when the pixel circuit operates in a display stage.

* * * * *